US008914942B2

(12) United States Patent
Courtney et al.

(10) Patent No.: US 8,914,942 B2
(45) Date of Patent: Dec. 23, 2014

(54) ATTACHMENT FOR A VACUUM CLEANING APPLIANCE

(75) Inventors: Stephen Benjamin Courtney, Malmesbury (GB); Leigh Michael Ryan, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 181 days.

(21) Appl. No.: 13/806,529

(22) PCT Filed: May 24, 2011

(86) PCT No.: PCT/GB2011/050976

§ 371 (c)(1), (2), (4) Date: Mar. 1, 2013

(87) PCT Pub. No.: WO2011/161428

PCT Pub. Date: Dec. 29, 2011

(65) Prior Publication Data

US 2013/0152336 A1 Jun. 20, 2013

(30) Foreign Application Priority Data

Jun. 21, 2010 (GB) ..... 1010365.3

(51) Int. Cl.

| | |
|---|---|
| ***A47L 5/10*** | (2006.01) |
| ***A47L 9/04*** | (2006.01) |
| ***A46B 15/00*** | (2006.01) |
| ***A47L 5/26*** | (2006.01) |
| ***A47L 9/28*** | (2006.01) |
| ***A46B 13/02*** | (2006.01) |

(52) U.S. Cl.

CPC ..... *A46B 15/00* (2013.01); *A47L 9/0433* (2013.01); *A46B 15/0002* (2013.01); *A47L 5/26* (2013.01); *A46B 15/0018* (2013.01); *A47L 9/2884* (2013.01); *A47L 9/2857* (2013.01); *A46B 13/02* (2013.01); *A47L 9/2842* (2013.01); *A47L 9/0461* (2013.01)

USPC ..... 15/383; 15/389

(58) Field of Classification Search

CPC ..... A46B 15/00; A47L 5/30; A47L 9/0477; A47L 9/0411; B08B 5/02; B08B 9/32; B08B 9/30

USPC ..... 15/383, 304, 406, 408, 246, 346.2, 15/336–338

See application file for complete search history.

(56) References Cited

U.S. PATENT DOCUMENTS 6,802,104 B1 * 10/2004 Redd ..... 15/393
7,203,986 B2 * 4/2007 Pears et al. ..... 15/28

(Continued)

FOREIGN PATENT DOCUMENTS

DE 40 35 519 5/1991
DE 198 48 787 4/2000

(Continued)

OTHER PUBLICATIONS

International Search Report and Written Opinion mailed Aug. 3, 2011, directed towards International Application No. PCT/GB2011/050976; 13 pages.

Search Report dated Oct. 20, 2010, directed to GB Application No. 1010365.3; 1 page.

*Primary Examiner* — Dung Van Nguyen

(74) *Attorney, Agent, or Firm* — Morrison & Foerster LLP

(57) ABSTRACT

An attachment for a vacuum cleaning appliance, the attachment including a head divided into a first rotatable member and a second rotatable member, each rotatable member comprising means for sweeping dirt from a surface, a conduit connectable to a vacuum cleaning appliance for conveying an air flow from the head towards the appliance, a drive mechanism for rotating the head about a first axis while simultaneously rotating the first rotatable member about a second axis and the second rotatable member about a third axis, each of the second axis and the third axis being angled to the first axis, and means for dislodging dirt from the sweeping means with rotation of the head about the first axis so that dislodged dirt may become entrained within the air flow.

25 Claims, 12 Drawing Sheets

(56) References Cited

U.S. PATENT DOCUMENTS

| | | | | |
|---|---|---|---|---|
| 7,437,797 | B2 * | 10/2008 | Ptak et al. | 15/398 |
| 7,571,514 | B2 * | 8/2009 | Shih | 15/393 |
| 7,578,025 | B2 * | 8/2009 | Kostreba et al. | 15/321 |
| 8,122,554 | B2 * | 2/2012 | Schemmel et al. | 15/24 |
| 2003/0192143 | A1 | 10/2003 | Beynon | |

FOREIGN PATENT DOCUMENTS

| | | |
|---|---|---|
| FR | 2 739 275 | 4/1997 |
| JP | 2001-87182 | 4/2001 |
| JP | 3105095 | 8/2004 |
| WO | WO-2005/089614 | 9/2005 |
| WO | WO-2007/018942 | 2/2007 |

* cited by examiner

ATTACHMENT FOR A VACUUM CLEANING APPLIANCE

REFERENCE TO RELATED APPLICATIONS

This application is a national stage application under 35 USC 371 of International Application No. PCT/GB2011/050976, filed May 24, 2011, which claims the priority of United Kingdom Application No. 1010365.3, filed Jun. 21, 2010, the entire contents of which are incorporated herein by reference.

FIELD OF THE INVENTION

The present invention relates to an attachment for a vacuum cleaning appliance, and to a cleaning appliance including such an attachment. In its preferred embodiment, the present invention relates to a dusting attachment for a vacuum cleaning appliance.

BACKGROUND OF THE INVENTION

A vacuum cleaner typically comprises a main body containing dirt and dust separating apparatus, a cleaner head connected to the main body and having a suction opening, and a motor-driven fan unit for drawing dirt-bearing air through the suction opening. The suction opening is directed downwardly to face the floor surface to be cleaned. The dirt-bearing air is conveyed to the separating apparatus so that dirt and dust can be separated from the air before the air is expelled to the atmosphere. The separating apparatus can take the form of a filter, a filter bag or, as is known, a cyclonic arrangement.

Vacuum cleaners generally include cylinder, or canister, cleaners, upright cleaners and hand-held cleaners. A cylinder vacuum cleaner includes a main body supported by a set of wheels which is dragged along a floor surface by a hose and wand assembly extending between the main body and the cleaner head. The cleaner head is generally releasably attached to the end of the wand remote from the main body. An upright vacuum cleaner typically comprises a main body, a pair of wheels mounted on the main body for maneuvering the vacuum cleaner over a floor surface to be cleaned, and a cleaner head mounted on the main body. In use, a user reclines the main body of the upright vacuum cleaner towards the floor surface, and then sequentially pushes and pulls a handle which is attached to the main body to manoeuvre the vacuum cleaner over the floor surface. Upright vacuum cleaners are often also provided with a hose and wand assembly connected to the main body through which air can be drawn into the vacuum cleaner, and a changeover valve which is moveable to connect either the hose and wand assembly or the cleaner head to the fan unit depending on whether the main body is in an upright or reclined position. This enables an upright vacuum cleaner to be used in the manner of a cylinder cleaner.

A range of cleaning tools is often supplied with all types of vacuum cleaner so that a user can choose an appropriate tool for their cleaning task. These tools generally include crevice tools and brush tools. These tools can be attached to the hose and wand assembly of a cylinder or upright vacuum cleaner, or to the suction opening of a hand-held vacuum cleaner.

It is also known to provide a rotating brush tool for attachment to the hose of a vacuum cleaner. For example, the brush tool described in DE 19848787 comprises a tubular housing which is connected at one open end to the hose, and has a brush protruding from the other open end of the housing. The brush is located on one end of a shaft extending along the longitudinal axis of the housing. A turbine connected to the other end of the shaft is rotated by an air flow generated by the vacuum cleaner which passes through the housing. During use, dust and other detritus dislodged from a surface by the rotating brush can become entrained within the air flow and conveyed to the main body of the vacuum cleaner.

A problem associated with this sort of brush tool is that dust and detritus can become trapped between the fibres of the brush, resulting in the tool becoming rapidly clogged with dirt and dust. As a result, the rate of capture of dirt and dust from the surfaces to be cleaned can reduce rapidly during use of the tool. This trapped dust can only be released from the brush by subsequent manual agitation of the brush fibres following the completion of a cleaning process, releasing dust and detritus back into the atmosphere to re-settle on surfaces. Also, depending on the speed of the rotation of the brush dirt can be flung outwardly from the brush at such a velocity that it does not become entrained within the air flow generated by the vacuum cleaner.

SUMMARY OF THE INVENTION

In a first aspect the present invention provides an attachment for a vacuum cleaning appliance, the attachment comprising a head divided into a first rotatable member and a second rotatable member, each rotatable member comprising means for sweeping dirt from a surface, a conduit connectable to a vacuum cleaning appliance for conveying an air flow from the head towards the appliance, a drive mechanism for rotating the head about a first axis while simultaneously rotating the first rotatable member about a second axis and the second rotatable member about a third axis, each of the second axis and the third axis being angled to the first axis, and means for dislodging dirt from the sweeping means with rotation of the head about the first axis.

Dislodging dirt from the sweeping means with rotation of the head about the first axis can enable dirt which had otherwise become trapped within the sweeping means, for example between bristles or filaments forming the sweeping means, to become entrained within the air flow passing from the head to the appliance. This can prevent the sweeping means from becoming clogged with dirt during use of the attachment, and so maintain a relatively even rate of capture of dust and dirt from the surfaces to be cleaned during use of the attachment.

The division of the head into first and second rotatable members, which rotate about respective axes angled to the axis about which the head is rotated, can enable parts of the head to rotate towards the conduit immediately after contact with the surface to be treated, which can have the effect of dirt and dust being flung towards the conduit rather than away from the conduit, again increasing the rate of dust capture by the attachment.

The rotation of the rotatable members about their respective axes can enable a focused sweeping action to be applied to a surface to be treated. When viewed in a direction extending along the second axis towards the first axis, the drive mechanism preferably rotates the first rotatable member about the second axis in a first angular direction and the second rotatable member about the third axis in a second angular direction opposite to the first angular direction. The contra-rotation of the first rotatable member relative to the second rotatable member, coupled with the rotation of the head about the first axis, has been found to afford a superior cleaning action than when the head is not so divided into first and second rotatable members, and so simply rotates about the first axis.

The dislodging means preferably extend partially about the head, and preferably partially about the first axis. The dislodging means are preferably located adjacent, and are more preferably connected to the conduit to increase the likelihood that dirt and dust dislodged from the sweeping means becomes entrained within the air flow.

The dislodging means preferably comprises at least one agitating member or structure for engaging the sweeping means as the head is rotated about the first axis. For example, the agitating member may comprise a mesh or web-like structure through which the sweeping means are swept as the head is rotated to dislodge dirt and dust therefrom. Alternatively, the dislodging means may comprise a plurality of agitating members for engaging the sweeping means as the head is rotated about the first axis. These agitating members are preferably angularly spaced, more preferably substantially equiangularly spaced, about the first axis. Each agitating member may be in the form of a finger, wedge, mesh, web-like structure or blade. For example, in a preferred embodiment the agitating members are in the form of curved blades extending away from the conduit. The agitating members preferably have a variety of different lengths. The radial depth of each agitating member preferably varies along the length thereof to vary the depth of penetration of the sweeping means into the agitating members with the rotation of the head about the first axis.

The agitating members are preferably disposed on or adjacent the inner surface of a shield located adjacent the head. The provision of this shield can reduce the risk of dirt and dust dislodged from the sweeping means by the agitating members being flicked outwardly away from the conduit, as the shield can act to deflect dirt and dust colliding therewith inwardly towards the conduit to become entrained within the air flow. The shield preferably extends about the head, and the first axis, and preferably has a generally spherical curvature. The agitating members are preferably integral with the shield, and may be in the form of raised ribs or blades extending along the inner surface of the shield. Alternatively, the agitating members may be separate from the shield, which may be formed from plastics material. The shield may have a degree of flexibility to allow the attachment to be pushed into tighter areas, and to reduce the risk of damage to objects or items of furniture through contact with the shield during a cleaning operation.

Each of the second axis and the third axis preferably intersects the first axis. Each of the second axis and the third axis may be substantially orthogonal to the first axis. The second axis and the third axis may be substantially co-linear, or they may be parallel to each other. Alternatively, each of the second axis and the third axis may be inclined relative to the first axis so that the rims of the rotatable members converge. This can enhance the sweeping action of the rotatable members at a particular part of a surface to be cleaned using the attachment.

The second and third axes may be oriented so that the inclination of the second axis relative to the first axis is the same as the inclination of the third axis relative to the first axis. For example, an angle subtended between the first axis and the second axis, and so between the first axis and the third axis, is preferably an obtuse angle, which is preferably between 90° and 120°, more preferably between 95° and 110°. However, the inclination of the second axis relative to the first axis may be different from the inclination of the third axis relative to the first axis. This can improve the sweeping action of the rotatable members relative to a particular part of a surface to which the first axis is tangential when the attachment is held by a user.

The first axis is preferably substantially co-planar with both the second axis and the third axis.

Each of the rotatable members is preferably symmetrical about a longitudinal axis thereof, which passes through the centre of its outer surface. Each of the first rotatable member and the second rotatable member may be dome-shaped, and may have a generally spherical curvature. In this case the head may be barrel-shaped, but the head is preferably substantially spherical. As an alternative to dome-shaped rotatable members, each of the first and second rotatable members may comprise a plurality of facets.

The drive mechanism may comprise a shaft for rotating the head about the first axis, and an actuator for actuating the rotation of the shaft. The actuator may comprise a motor, which may be located to one side of the conduit, within a separate motor housing, or within the conduit. The motor may be powered by a battery located in a battery housing of the attachment, or by the vacuum cleaning appliance to which the attachment is connected. For example, when the attachment is connected to the appliance an electrical connection may be made between the motor and a power source of the vacuum cleaning appliance. However, alternative types of actuator can include an air turbine which is connected to the shaft and located within the conduit for rotation by the air flow.

The drive mechanism may comprise bevel gears for rotating the rotatable members. The bevel gears preferably comprise a first bevel gear which extends about the shaft and which is not rotated by the shaft, and second and third bevel gears which are each connected to a respective one of the rotatable members. Each of these second and third bevel gears may be connected to the shaft for rotation about the first axis, and mesh with the first bevel gear so that each of the second and third bevel gears rotates about a respective one of the second axis and the third axis as the head is rotated about the first axis. Each of the second and third bevel gears may be detachably connected to a respective stub shaft extending outwardly from the shaft, each stub shaft extending along a respective one of the second and third axes. For example, the bevel gears may be magnetically connected to its respective stub shaft. This can enable each rotatable member to be readily detached from the shaft, for example for replacement or to facilitate removal of any matter which may have become tangled within the sweeping means of the head.

The first bevel gear preferably has a plurality of teeth which surround the first axis. The number of teeth of the first bevel gear is preferably higher or lower than the number of teeth of each of the second and third bevel gears so that the gear ratio between the first bevel gear and each of the second and third bevel gears is other than 1:1. This gear ratio means that the sweeping means of each rotatable member is drawn over different parts of the dislodging means with each rotation of the head about the first axis, varying the penetration of the dislodging means within the sweeping means with each rotation of the head.

As an alternative to gears, the drive mechanism may comprise a friction drive for rotating the rotatable members about the second axis and the third axis respectively.

The sweeping means preferably comprises a plurality of bristles, filaments or other sweeping members extending outwardly from each rotatable member. The sweeping members may be arranged in a plurality of tufts. The sweeping members preferably cover at least half of the outer surface of each rotatable member, more preferably at least 80% of the outer surface, and even more preferably substantially covers the outer surface of each rotatable member so that no patterns of dirt or dust are formed on a surface over which the head is maneuvered.

The bristles or filaments are preferably formed from one of plastics, nylon, acrylic, metallic, natural, carbon fibre, carbon composite, carbon-suffused nylon, Thunderon® or conductive acrylic material. Providing the head with electrically conductive sweeping members can enable static electricity residing on a surface to be cleaned to be discharged upon contact between the sweeping members and the surface. This enables fine dust and powder which would otherwise be attracted to the surface to be dislodged from the surface.

The surface resistivity of the sweeping members is preferably in the range from $1\times10^{-5}$ to $1\times10^{12}\Omega$/sq (ohms per square). Values of surface resistivity discussed herein are as measured using the test method ASTM D257. The selection of material having a surface resistivity in this range can ensure that any static electricity on the surface is effectively discharged by the head. For example, material comprising carbon particles and carbon fibres generally has a surface resistivity in the range from $1\times10^{3}$ to $1\times10^{6}$ $\Omega$/sq, whereas metallic material generally has a much lower surface resistivity, generally lower than 1 $\Omega$/sq. Other static dissipative materials generally have a surface resistivity in the range from $1\times10^{5}$ to $1\times10^{12}\Omega$/sq.

A suction opening of the conduit is preferably located adjacent the dislodging means. The head preferably protrudes partially through the suction opening.

The attachment is preferably in the form of a dusting attachment, but depending on the composition and/or stiffness of the sweeping means that attachment may also be in the form of a polishing attachment or an attachment for cleaning upholstery, carpets or the like. The attachment may be attachable to the end of a wand of a hose and wand assembly of a cylinder or upright cleaner, or it may be attachable to a suction inlet of a hand-held cleaner. Alternatively, the attachment may be attachable to one end of a hose, with the other end of the hose being connectable to the wand or the suction inlet of a cleaner. This can improve handling and maneuvering of the attachment by the user.

In a second aspect the present invention provides a vacuum cleaning appliance comprising an attachment as aforementioned.

Instead of being in the form of an attachment for a vacuum cleaner, a separate cleaning tool having all of the features of the attachment as aforementioned may be provided as a standalone item. Therefore, in a third aspect the present invention provides a cleaning appliance comprising a motor-driven fan unit for generating an air flow, a head divided into a first rotatable member and a second rotatable member, each rotatable member comprising means for sweeping dirt from a surface, a conduit for conveying the air flow from the head towards the fan unit, a drive mechanism for rotating the head about a first axis while simultaneously rotating the first rotatable member about a second axis and the second rotatable member about a third axis, each of the second axis and the third axis being angled to the first axis, and means for dislodging dirt from the sweeping means with rotation of the head about the first axis.

The cleaning appliance preferably comprises a cyclonic separating apparatus and/or a filter for removing the dirt from the air flow before it is exhausted into the atmosphere.

Features described above in connection with the first aspect of the invention are equally applicable to any of the second to third aspects of the invention, and vice versa.

BRIEF DESCRIPTION OF THE DRAWINGS

An embodiment of the invention will now be described, by way of example only, with reference to the accompanying drawings in which.

DETAILED DESCRIPTION OF THE INVENTION

Figure 1:
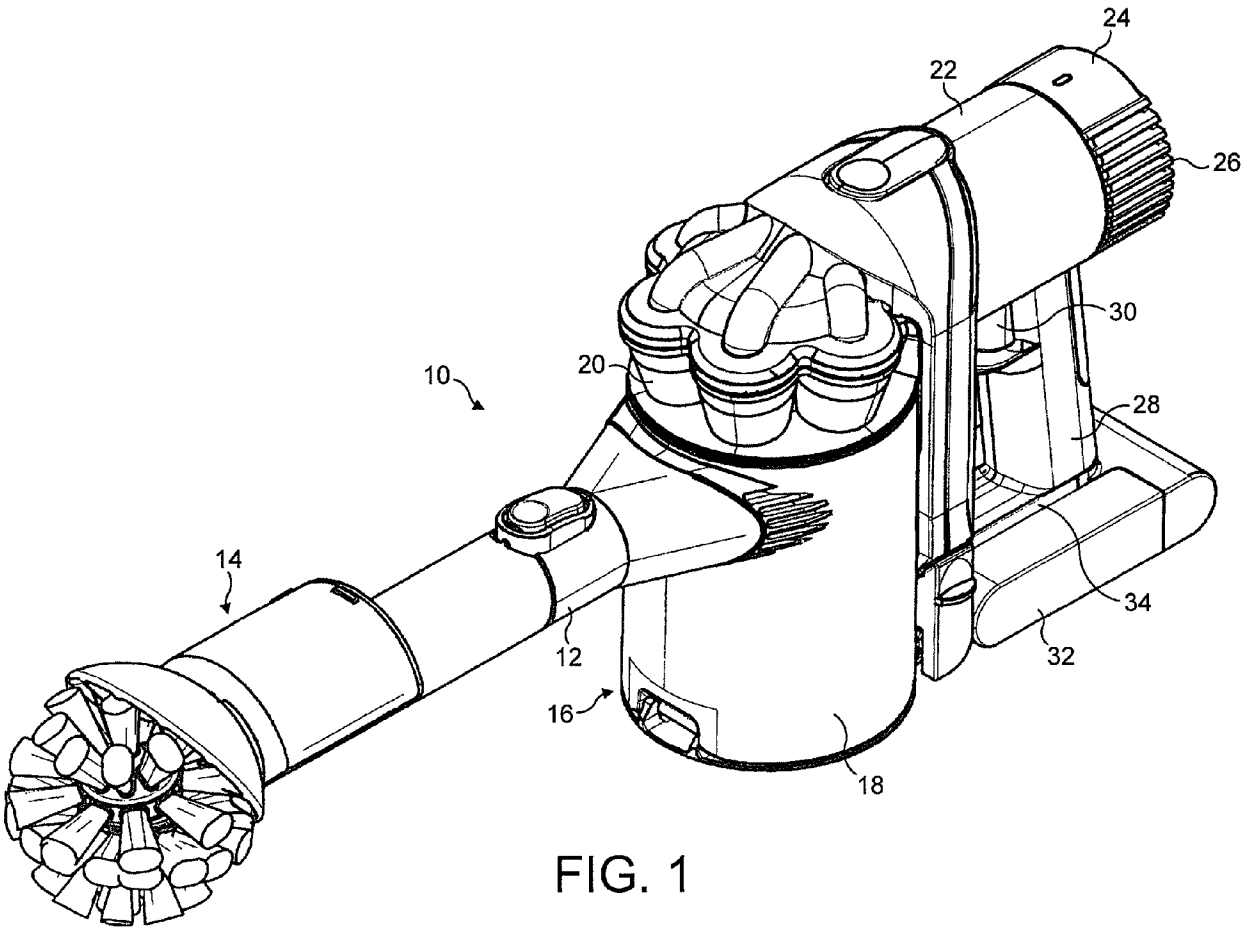
FIG. 1 is a front perspective view, from above, of a cleaning appliance to which a cleaning tool is connected.
Figure 2:
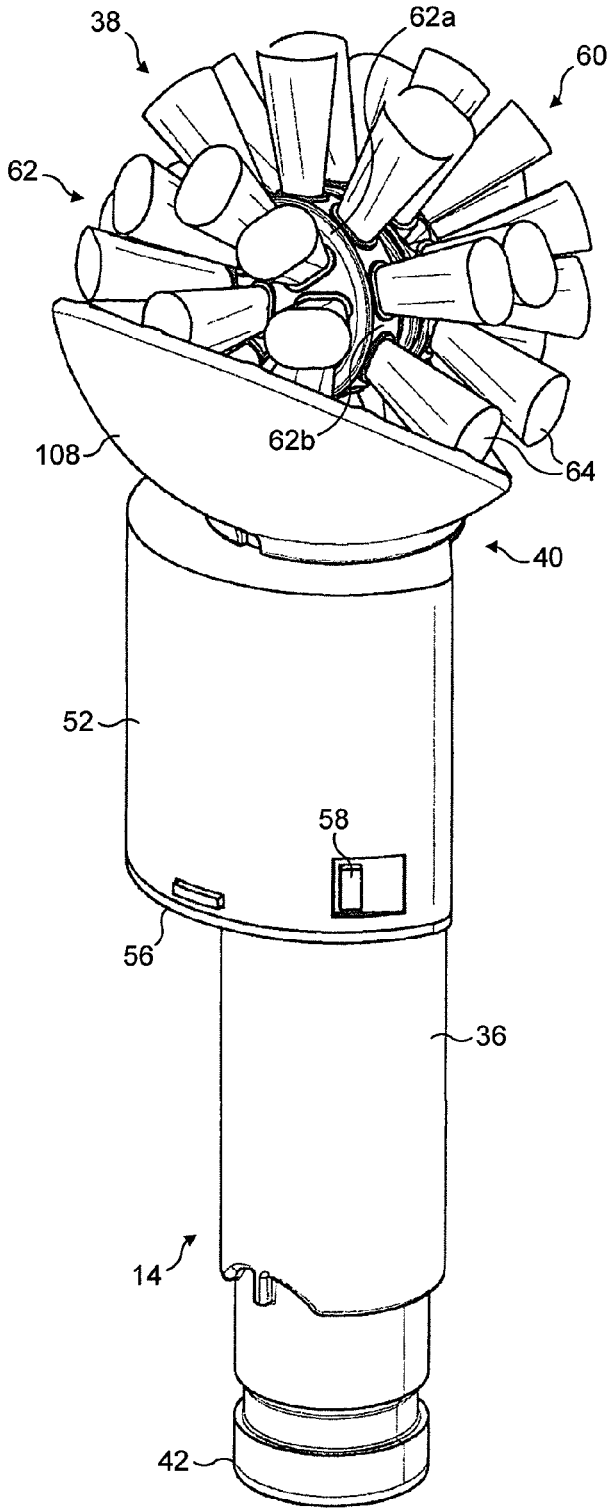
FIG. 2 is a right perspective view of the cleaning tool.
Figure 3:
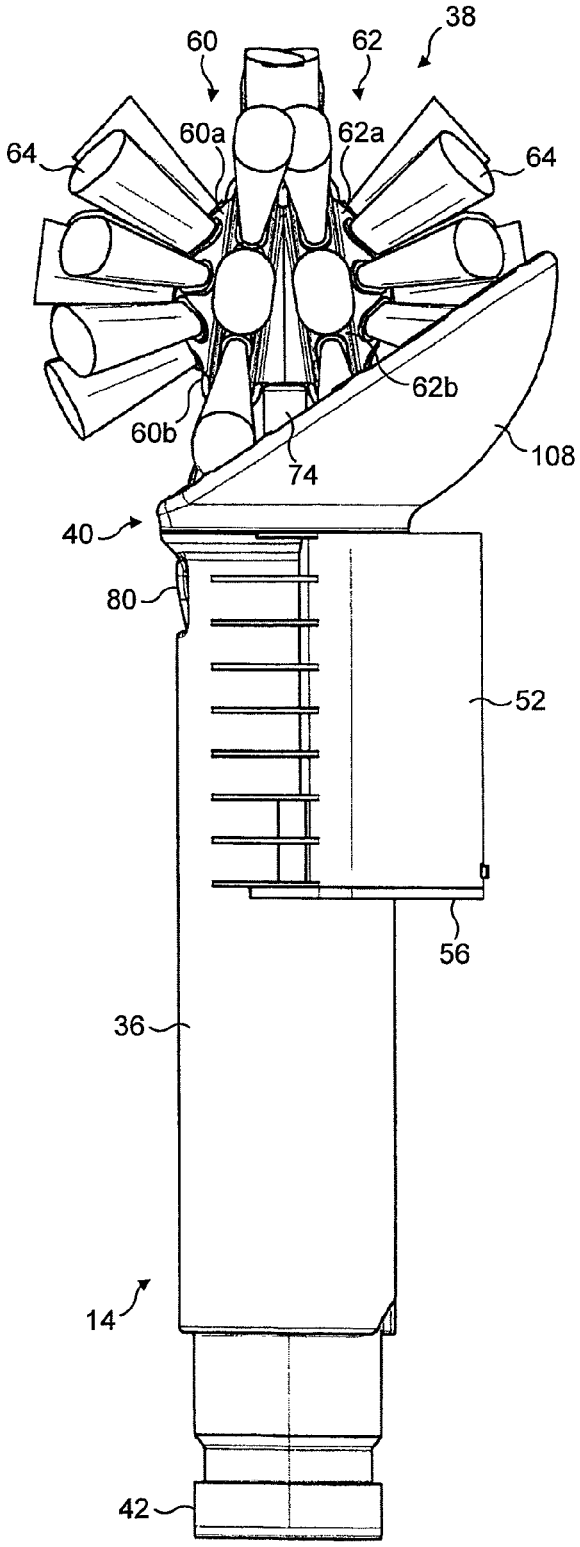
FIG. 3 is a left side view of the cleaning tool.
Figure 4:
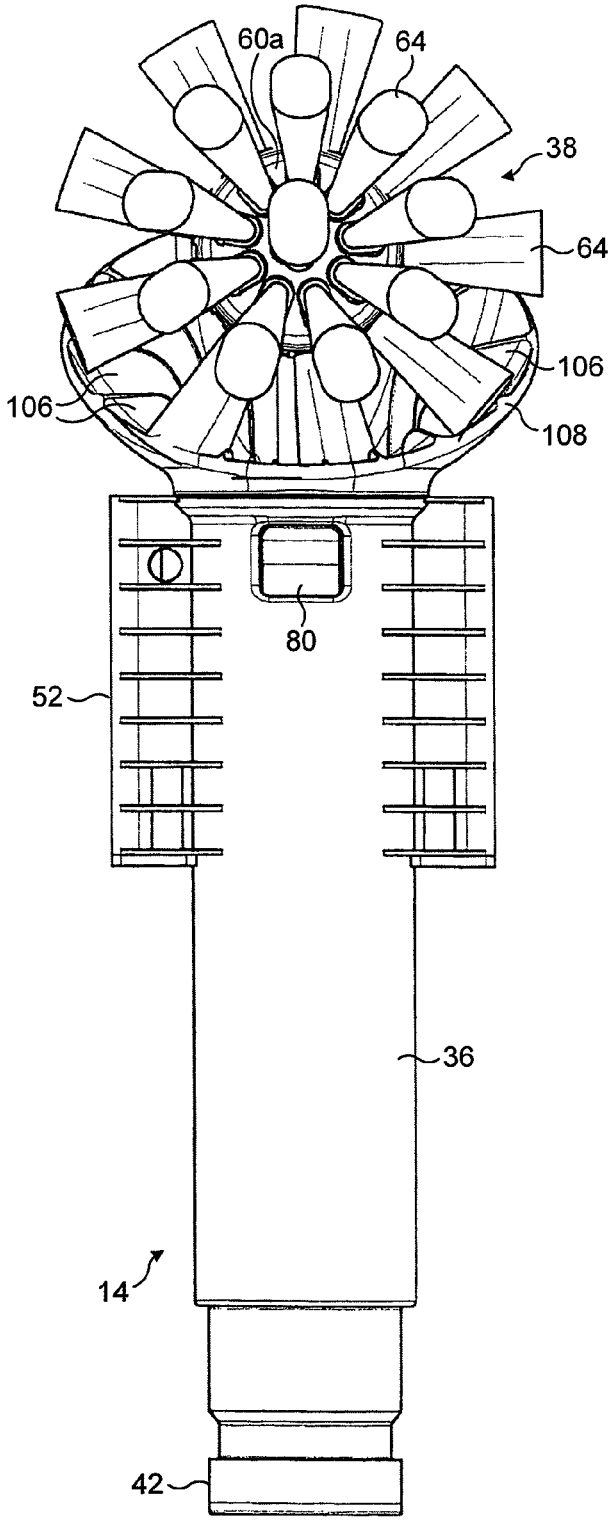
FIG. 4 is a bottom view of the cleaning tool.
Figure 5:
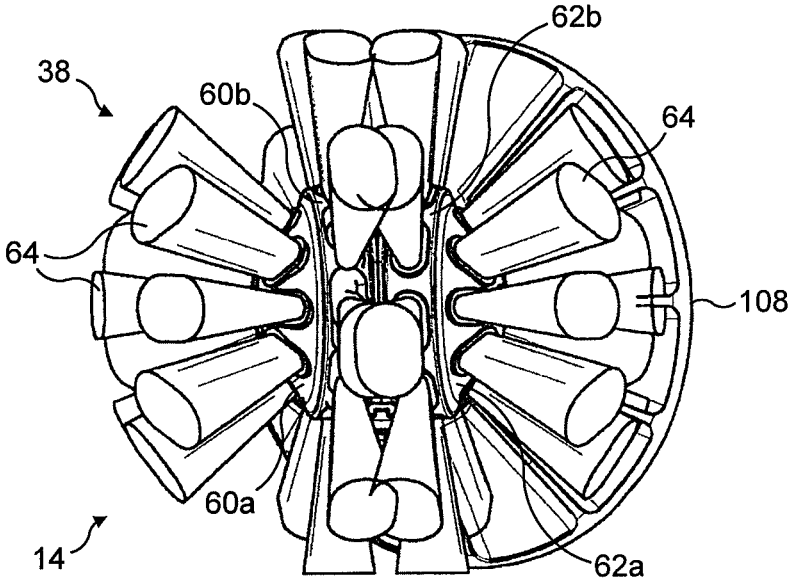
FIG. 5 is a front view of the cleaning tool.
Figure 6:
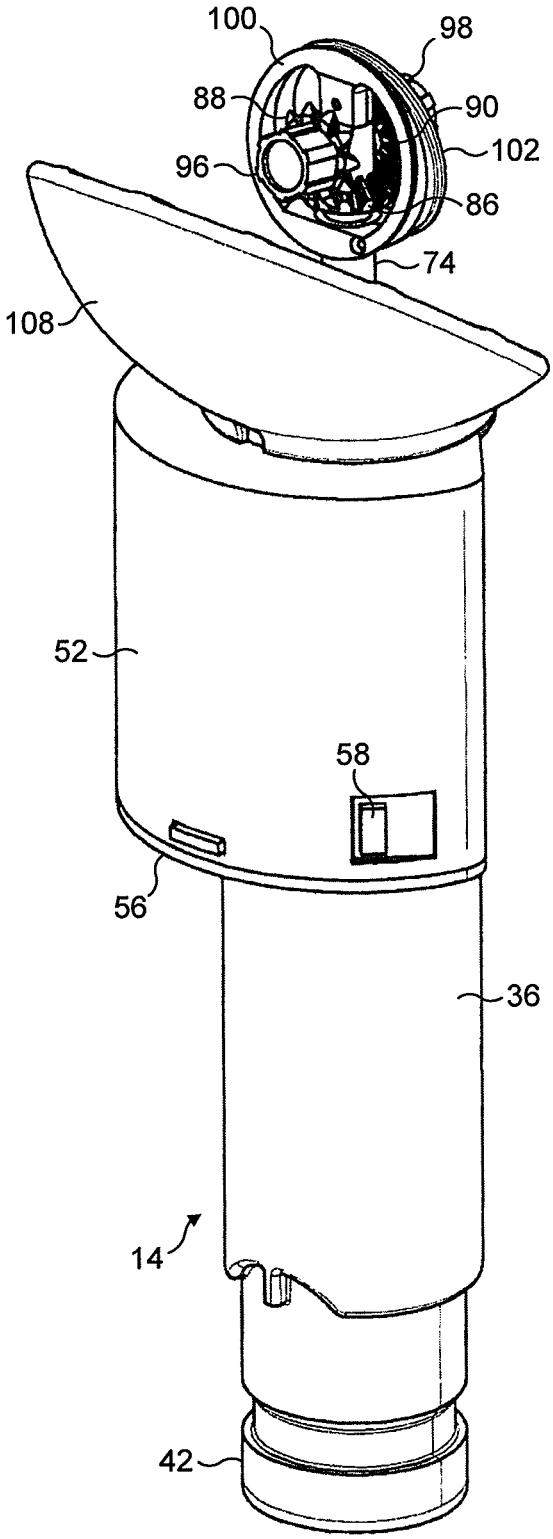
FIG. 6 is a right perspective view of the cleaning tool, with the rotatable members of the head removed.
Figure 7:
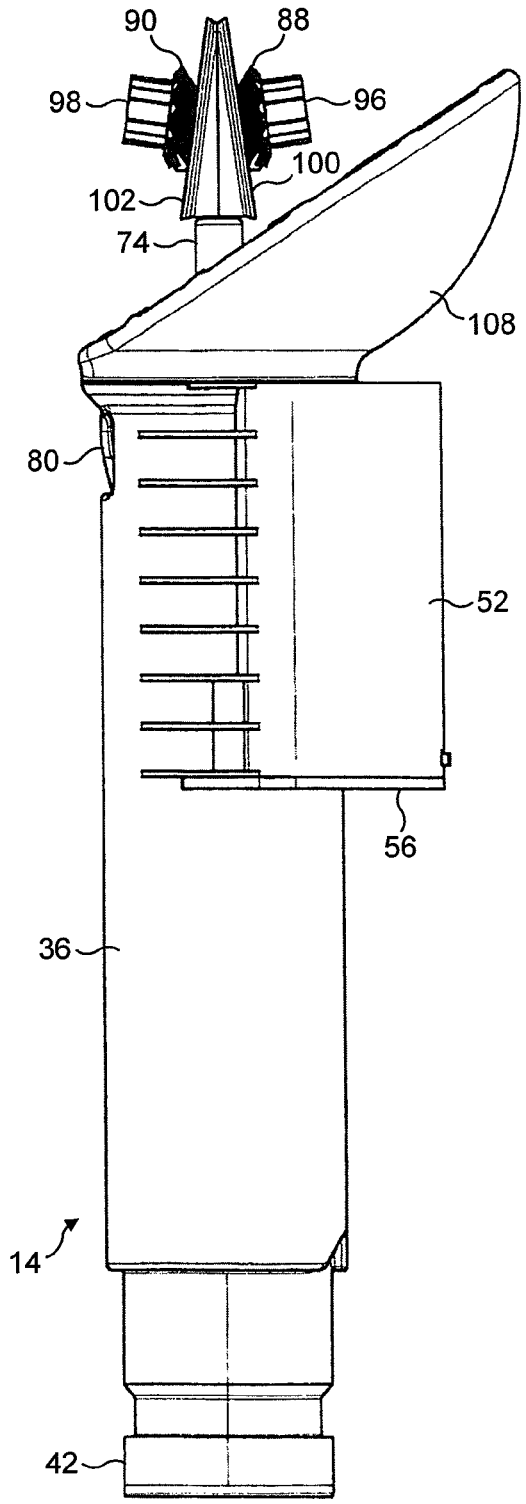
FIG. 7 is a left side view of the cleaning tool, with the rotatable members of the head removed.
Figure 8:
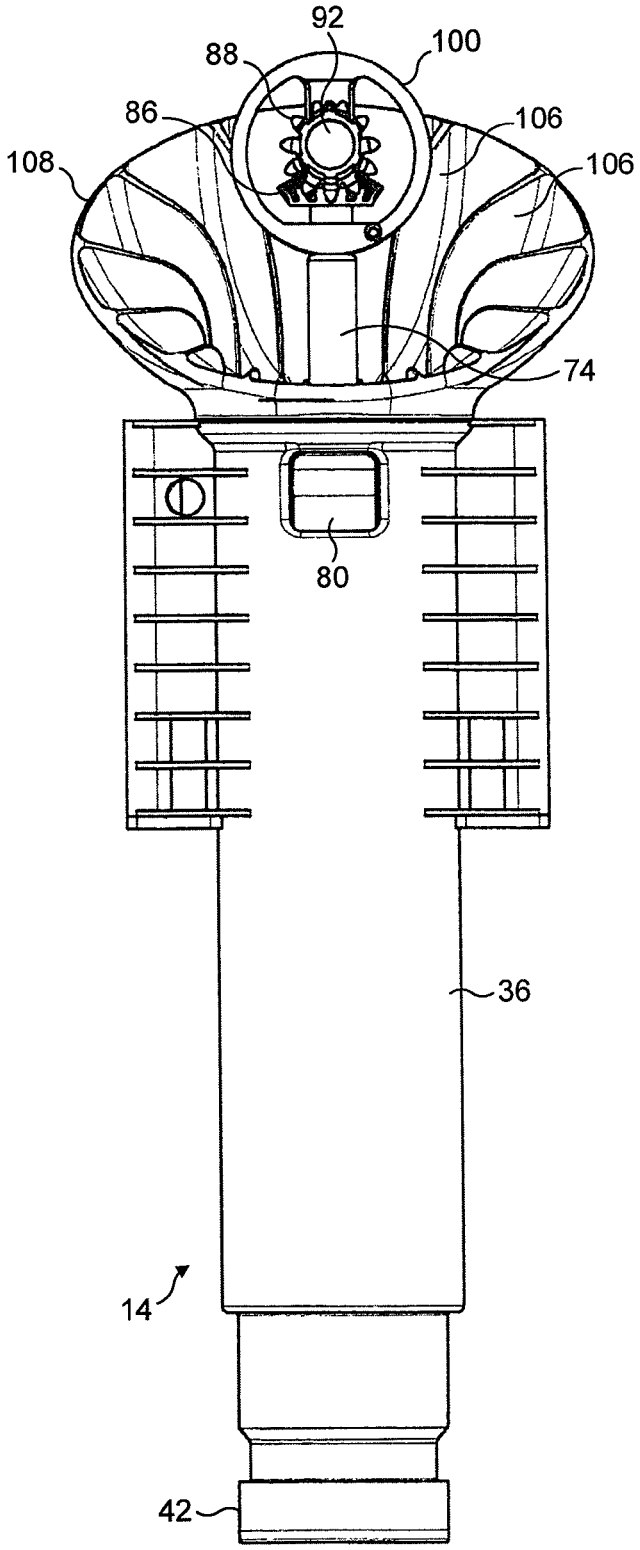
FIG. 8 is a bottom view of the cleaning tool, with the rotatable members of the head removed.

FIG. 1 illustrates a hand-held vacuum cleaner 10 as an example of a cleaning appliance. The vacuum cleaner 10 comprises a suction conduit 12 connected to a cleaning tool 14, and cyclonic separating apparatus 16 for separating dirt and dust from an airflow drawn into the vacuum cleaner 10 through a suction opening of the tool 14. The cyclonic separating apparatus 16 comprises an upstream cyclone 18 and a plurality of downstream cyclones 20.

The vacuum cleaner 10 further includes a motor housing 22 containing a motor-driven fan unit for drawing an air flow through the vacuum cleaner 10, and a removable casing 24 having a plurality of exhaust vents 26 formed therein. An air flow path extends from the tool 14, through the suction conduit 12, the cyclonic separating apparatus 16 and the motor housing 22 to the exhaust vents 26. A handgrip 28 is located below the motor housing 22 for manipulating the vacuum cleaner 10 when in use. The handgrip 28 is arranged so that the cyclonic separating apparatus 16 is located between the handgrip 28 and the cleaning tool 14. The handgrip 28 includes a trigger switch 30 which is positioned on the side of the handgrip 28 closest to the cyclonic separating apparatus 16 such that the trigger switch 30 can be manipulated by the index finger of the hand used to grip the handgrip 28. A power source 32 in the form of a lithium ion battery pack is connected to the handgrip 28 through a mounting portion 34.

When operating, the fan unit draws a flow of dirt- and dust-laden air into the suction opening of the tool 14, through the suction conduit 12 and into the cyclonic separating apparatus 16. The cleaned air exits the cyclonic separating apparatus 16, and passes sequentially through a pre-motor filter if present and the fan unit before being exhausted through the exhaust vents 26.

The tool 14 is illustrated in more detail in FIGS. 2 to 11. The tool 14 is in the form of an attachment which is detachably connectable to the suction conduit 12 of the vacuum cleaner 10. Alternatively, a hose (not shown) may be disposed between the suction conduit 12 and the cleaning tool 14 to allow a user to manoeuvre the tool 14 over a surface with one hand while operating the vacuum cleaner 10 with the other hand. A wand may connected between the cleaning tool 14 and the hose to increase the user's reach.

Figure 9A:
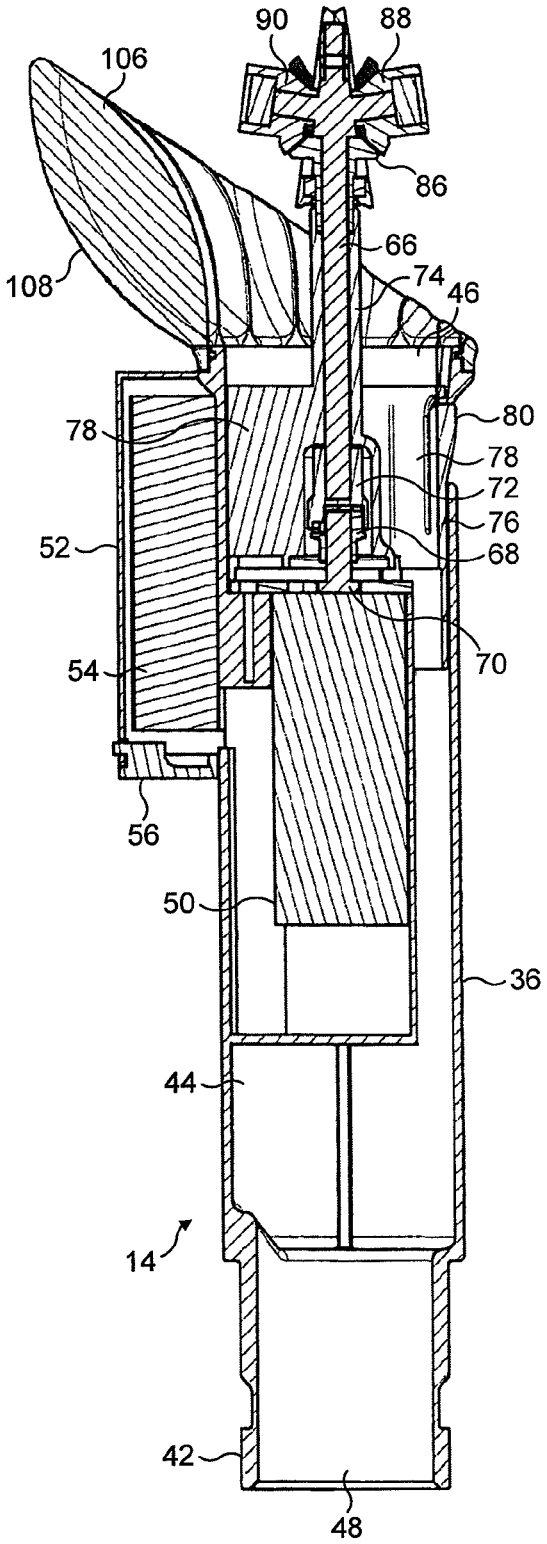
FIG. 9(*a*) is a sectional view of the cleaning tool, with the rotatable members of the head removed, and FIG. 9(*b*) is a close-up of part of FIG. 9(*a*)
Figure 9B:
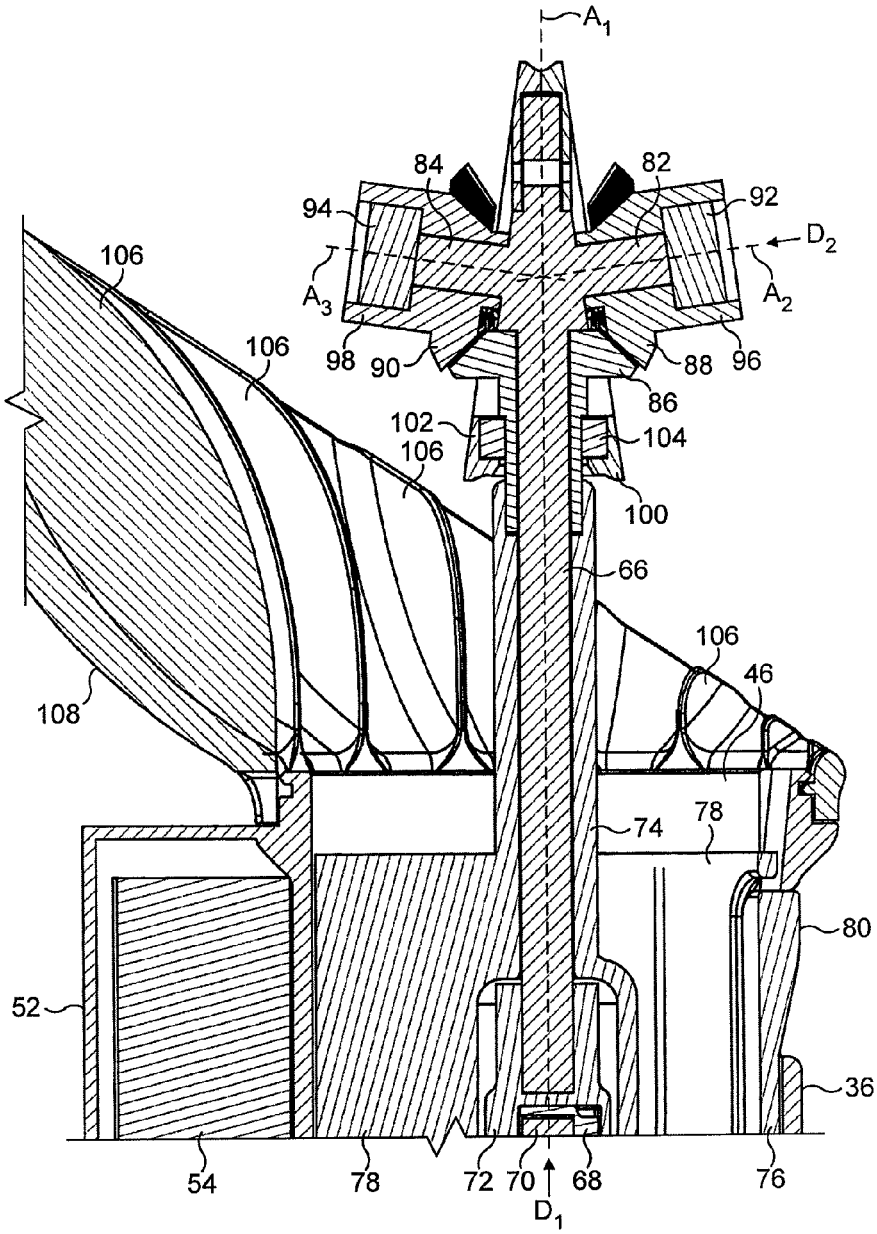

With reference first to FIGS. 2 to 5, the tool 14 comprises a body 36 and a cleaning head 38 located at a first end 40 of the body 36. A second end 42 of the body 36 is detachably connectable to the suction conduit 12 of the vacuum cleaner 10. With reference also to FIG. 9(*a*), the body 36 comprises a conduit 44 which extends from a suction opening 46 located at the first end 40 of the body 36 to an outlet 48 located at the second end 42 of the body 36. The conduit 44 conveys the air flow generated by the motor-driven fan unit of the vacuum cleaner 10 from the suction opening 46 to the suction conduit 12 of the vacuum cleaner 10.

The body 36 houses a motor 50 of a drive mechanism for rotating the head 38 of the tool 14 relative to the body 36. The body 36 comprises a battery casing 52 which houses a battery 54 for supplying power to the motor 50. The battery 54 may be a rechargeable battery, such as a nickel-metal hydride battery, and so recharging terminals may be provided on the body 36 for connection to a recharging base station. Alternatively, the battery 54 may be a non-rechargeable battery, in which case the battery 54 may be accessed for replacement through opening a flap 56 located to one side of the battery casing 52. A manually operable switch 58 is located on one side of the battery casing 52 to allow a user to selectively activate and deactivate the motor 50 to control the rotation of the head 38 relative to the body 36.

The head 38 is generally spherical in shape, and comprises a first rotatable member 60 and a second rotatable member 62. Each of the rotatable members 60, 62 is symmetrical about a longitudinal axis passing through the centre of its outer surface. In this embodiment, each of the rotatable members 60, 62 has a dome-shaped portion 60*a*, 62*a*, having an outer surface with a generally spherical curvature, and an annular portion 60*b*, 62*b*, extending about the base of the dome-shaped portion 60*a*, 62*a*.

Each of the first and second rotatable members 60, 62 comprises a plurality of sweeping members 64 in the form of bristles or filaments extending outwardly therefrom. In this example, the sweeping members 64 are arranged in clumps or tufts extending radially outwardly from both the dome-shaped portion 60*a*, 62*a* and the annular portion 60*b*, 62*b* of each rotatable member 60, 62. As an alternative to clumps of sweeping members 64, a cloth or pad having bristles, filaments or other sweeping members covering the majority of the surface of the cloth may be attached to the outer surface of each of the first and second rotatable members 60, 62. In this example the sweeping members 64 are formed from carbon-suffused nylon, but the sweeping members 64 may be formed from plastics, metallic, natural, carbon fibre, carbon composite, or conductive acrylic material depending on the purpose of the cleaning tool 14. For example, the sweeping members 64 are preferably formed from relatively stiff material when the cleaning tool 14 is to be used for cleaning car upholstery, whereas the sweeping members 64 are preferably formed from relatively flexible material when the cleaning tool 14 is to be used for dusting. Providing the head 38 with electrically conductive sweeping members 64 can enable static electricity residing on a surface to be cleaned to be discharged upon contact between the sweeping members 64 and the surface. This enables fine dust and powder which would otherwise be attracted to the surface to be dislodged from the surface by the head 38.

With reference to FIGS. 9(*a*) and 9(*b*), the drive mechanism comprises a drive shaft 66 which is rotated by the motor 50. Depending on the speed of the motor 50, the drive mechanism may be provided with a two stage epicyclical gearbox between the motor 50 and the drive shaft 66. The speed at which the drive shaft 66 is rotated by the motor 50 depends on the function of the cleaning tool 14. For example, if the cleaning tool 14 is to be used as a dusting tool then the drive shaft 66 is preferably rotated at a speed in the range from 300 to 700 revolutions per minute, whereas if the cleaning tool 14 is to be used for cleaning upholstery then the drive shaft 66 is preferably rotated at a faster speed. However, the speed at which the drive shaft 66 is rotated by the motor 50 is not material to the present invention. To connect the drive shaft 66 to the motor 50, the drive mechanism comprises a drive dog 68 which is connected, and rotated by, a motor shaft 70 extending from the motor 50. The drive dog 68 engages with a driven dog 72 connected to one end of the drive shaft 66.

The drive shaft 66 is housed within a sleeve 74 which remains stationary as the drive shaft 66 is rotated by the motor 50. The drive shaft 66, driven dog 72 and the sleeve 74 form part of a cartridge which is insertable into the body 36 thorough the suction opening 46. The cartridge comprises a cylinder 76 which surrounds the driven dog 72 and the ends of the drive shaft 66 and sleeve 74 adjacent the motor 50. The cylinder 76 is connected to the sleeve 74 by a plurality of vanes 78 (in this example, three vanes 78) which extend radially between the sleeve 74 and the cylinder 76. A mesh may extend across the lower end of the cylinder 76 to provide a relatively course filter for preventing relatively large dust or dirt particles from passing through the cleaning too 14 to the suction conduit 12 of the vacuum cleaner 10. A resilient catch 80 formed on the outer surface of the cylinder 76 protrudes through an opening located on the body 36 of the cleaning tool 14 when the cartridge is inserted into the body 36 to retain the cartridge within the body 36 so that the driven dog 72 engages with the drive dog 68. The cartridge may be removed from the body 36, for example to clean the mesh, by depressing the catch 80 and pulling the head 38 away from the body 36.

With particular reference to FIG. 9(*b*), the drive shaft 66 is arranged to rotate the head 38 about a first axis $A_1$, which in this example is co-linear with the longitudinal axis of the drive shaft 66 and passes through the centre of the head 38. The distal end of the drive shaft 66 comprises first and second stub shafts 82, 84 extending outwardly therefrom. The first stub shaft 82 extends along a second axis $A_2$ and the second stub shaft 84 extends along a third axis $A_3$. Each of the second axis $A_2$ and the third axis $A_3$ is co-planar with, and angled at an obtuse angle to, the first axis $A_1$. In this example, this angle is around 98°.

As also illustrated in FIGS. 5 to 8, the drive mechanism comprises a first bevel gear 86 which extends about the drive shaft 66 and is connected to the sleeve 74 so that the first bevel gear 86 is not rotated by the drive shaft 66. The drive mechanism further comprises a second bevel gear 88 connected to the first stub shaft 82 so as to extend about the second axis $A_2$ and a third bevel gear 90 connected to the second stub shaft 84 so as to extend along a third axis $A_3$. In this example the drive shaft 66 is formed from steel, and the second and third bevel gears 88, 90 are each urged against the first bevel gear 86 by a respective magnet 92, 94 located within a magnet housing 96, 98 which is integral with the bevel gear 88, 90. The strength of each magnet 92, 94 is selected to allow the rotatable members 60, 62 to rotate relative to the drive shaft 66.

Each of the second and third bevel gears 88, 90 is connected to a respective one of the rotatable members 60, 62, for example using an adhesive. Each rotatable member 60, 62 is then connected to the drive shaft 66 by locating its bevel gear 88, 90 over one of the stub shafts 82, 84 and pushing the rotatable member 60, 62 towards the drive shaft 66 so that the bevel gear 88, 90 meshes with the first bevel gear 86. When the rotatable member 60, 62 is released, the bevel gear 88, 90 remains urged against the first bevel gear 86 by the magnet 92, 94. The magnets 92, 94 also serve to urge the rim 60*b*, 62*b* of each rotatable member 60, 62 against a respective annular support 100, 102. Each annular support 100, 102 is substantially orthogonal to a respective one of the second and third axes $A_2$, $A_3$, and is connected at the distal end thereof to the end of the drive shaft 66 so that the annular supports 100, 102 rotate with the drive shaft 66. The lower ends of the annular supports 100, 102 are supported by a bearing 104 extending around the sleeve 74. The annular supports 100, 102 also prevent dust and dirt from passing between the rotatable members 60, 62 to block or other impede the drive mechanism.

The motor 50 may be arranged to rotate the head 38 in either a clockwise or an anti-clockwise direction when viewed in a direction $D_1$ (indicated in FIG. 9(*b*)) extending along the first axis $A_1$ from the motor 50 towards the head 38. In this example, the motor 50 is arranged to rotate the head 38 in an anti-clockwise direction when viewed in a direction $D_1$. When viewed from a direction $D_2$ (also indicated in FIG. 9(*b*)) which extends along the second axis $A_2$ towards the first axis $A_1$, the first rotatable member 60 rotates in an anti-clockwise direction about the second axis $A_2$ while the second rotatable member 62 rotates in a clockwise direction about the third axis $A_3$. As a result, the first and second rotatable members 60, 62 can impart the same sweeping action over a surface engaged by the head 38 of the tool 14. Dirt and dust residing from the surface can be dislodged from that surface by the sweeping members 64 and become entrained within the air flow drawn through the suction opening 46 by the vacuum cleaner 10.

With particular reference now to FIGS. 8 to 11, the tool 14 further comprises a plurality of agitating members 106 for engaging the sweeping members 64 as the head 38 is rotated about the first axis $A_1$ to dislodge dirt and dust from the sweeping members 64. This dislodged dirt and dust can then become entrained within the air flow drawn through the suction opening 46 by the vacuum cleaner 10. The agitating members 106 are arranged in an annular array extending about the first axis $A_1$, in which the agitating members 106 are preferably generally equi-angularly spaced about the first axis $A_1$. In this example, each agitating member 106 is in the form of a curved blade which extends forwardly and radially outwardly from the suction opening 46 of the conduit 44. When viewed along the first axis $A_1$, the length of the agitating members 106 varies from a minimum value towards the bottom of the tool 14 to a maximum value towards the top of the tool, with the distal ends of the agitating members 106 being located in a common plane which is inclined at an angle of around 55° to the first axis $A_1$.

Figure 10:
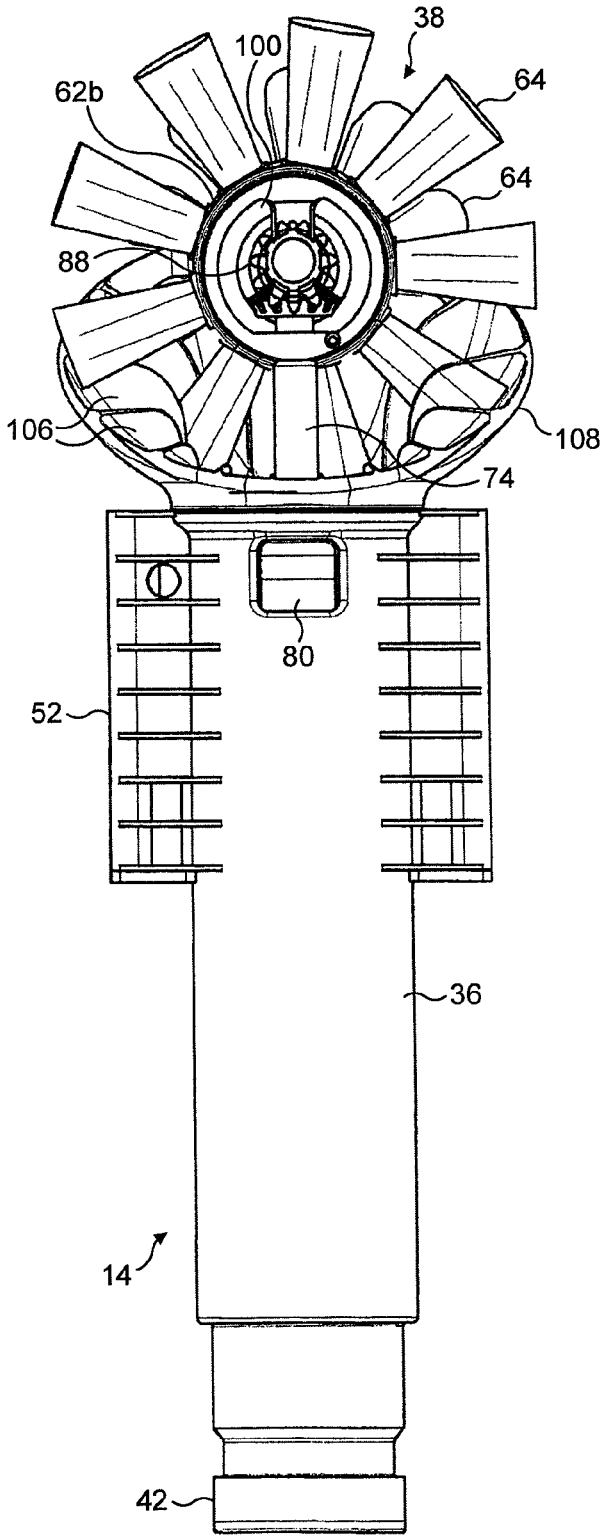
FIG. 10 is a bottom view of the cleaning tool, with one of the rotatable members of the head removed.
Figure 11:
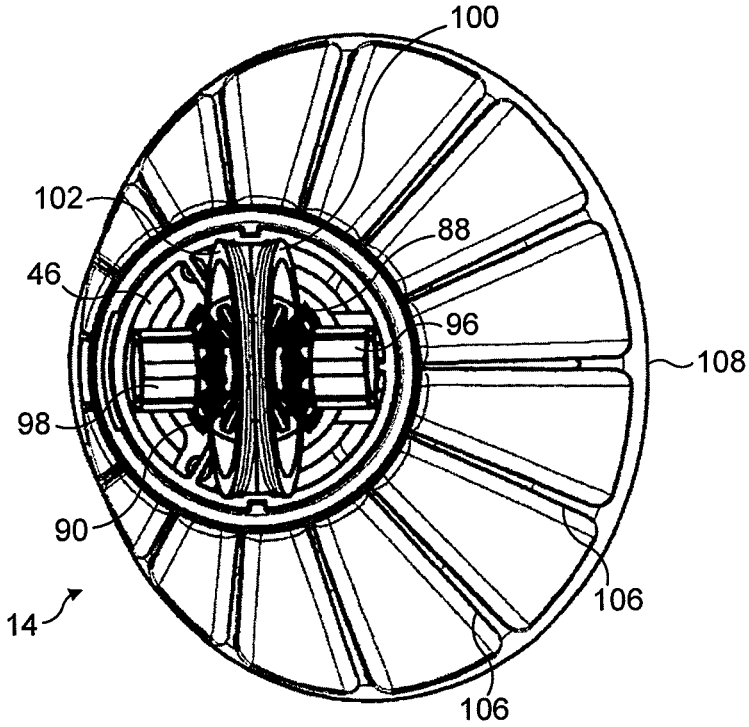
FIG. 11 is a front view of the cleaning too, with the rotatable members of the head removed.

As can be seen most clearly from FIG. 10, the sweeping members 64 pass between and over the agitating members 106 with rotation of the head 38 about the first axis $A_1$. The radial depth of each agitating member 106 preferably varies along the length thereof to vary the depth of penetration of the sweeping members 64 into the agitating members 106 with the rotation of the head 38 about the first axis $A_1$.

The extent to which each clump or tuft of sweeping members 64 comes into contact with the agitating members 106 varies with each rotation of the head 38 about the first axis $A_1$. The gear ratio between the first bevel gear 86 and each of the second and third bevel gears 88, 90 is selected to be other than 1:1, and in this example is 1:1.127, so that each clump or tuft of sweeping members 64 is subjected to a uniform agitation by the agitating members 106 after a given number of rotations of the head 38 about the first axis $A_1$.

In this example, the agitating members 106 are disposed on the inner surface of a shield 108 located adjacent the head 38. The shield 108 is connected to the first end 40 of the body 36 of the tool 14. The shield 108 has a domed, preferably spherical curvature to deflect any dirt and dust which has been deflected outwardly by the agitating members 106 back towards the suction opening 46 to become entrained with the air flow generated by the vacuum cleaner. The shield 108 may be formed from a relatively rigid plastics material, or from a relatively flexible material, such as a rubber or relatively flexible plastic, to allow the shield 108 to deform upon contact with a surface.

The invention claimed is:

1. An attachment for a vacuum cleaning appliance, the attachment comprising:

a head divided into a first rotatable member and a second rotatable member, each rotatable member comprising a sweeping mechanism that sweeps dirt from a surface;

a conduit connectable to a vacuum cleaning appliance configured to convey an air flow from the head towards the appliance;

a drive mechanism configured to rotate the head about a first axis while simultaneously rotating the first rotatable member about a second axis and the second rotatable member about a third axis, each of the second axis and the third axis being angled to the first axis; and a dislodging mechanism configured to dislodge dirt from the sweeping mechanism with rotation of the head about the first axis.

2. The attachment of claim 1, wherein the dislodging mechanism comprises a plurality of agitating members configured to engage the sweeping mechanism.

3. The attachment of claim 1, comprising a shield configured to deflect dirt dislodged from the sweeping mechanism towards the conduit.

4. The attachment of claim 3, wherein the dislodging mechanism is integral with the shield.

5. The attachment of claim 1, wherein the shield extends at least partially about the head.

6. The attachment of claim 1, wherein the dislodging mechanism extends at least partially about the head.

7. The attachment of claim 1, wherein the dislodging mechanism is connected to the conduit.

8. The attachment of claim 1, wherein each of the second axis and the third axis is inclined to the first axis.

9. The attachment of claim 8, wherein the inclination of the second axis to the first axis is the same as the inclination of the third axis to the first axis.

10. The attachment of claim 9, wherein an angle subtended between the first axis and the second axis is between 60° and 90°.

11. The attachment of claim 1, wherein the first axis is substantially co-planar with at least one of the second axis and the third axis.

12. The attachment of claim 1, wherein each of the first rotatable member and the second rotatable member is dome-shaped.

13. The attachment of claim 1, wherein each of the first rotatable member and the second rotatable member has a generally spherical curvature.

14. The attachment of claim 1, wherein the head is spherical.

15. The attachment of claim 1, wherein the sweeping mechanism comprises a plurality of bristles extending outwardly from each rotatable member.

16. The attachment of claim 15, wherein the bristles are arranged in a plurality of tufts.

17. The attachment of claim 15, wherein the bristles are formed from material having a surface resistivity in the range from $1\times10^{-5}$ to $1\times10^{12}\Omega$/sq.

18. The attachment of claim 15, wherein the bristles are formed from one of nylon, acrylic, natural, carbon fibre, carbon composite, carbon suffused nylon, metallic and conductive acrylic material.

19. The attachment of claim 1, wherein the drive mechanism comprises a plurality of bevel gears.

20. The attachment of claim 1, wherein the drive mechanism comprises one of a motor and an air turbine.

21. The attachment of claim 1, wherein the conduit comprises a suction opening located adjacent the dislodging mechanism.

22. The attachment of claim 21, wherein the head protrudes partially through the suction opening.

23. The attachment of claim 1, in the form of a dusting attachment.

24. A vacuum cleaning appliance comprising the attachment of claim 1.

25. A cleaning appliance comprising:

a motor-driven fan unit configured to generate an air flow;

a head divided into a first rotatable member and a second rotatable member, each rotatable member comprising a sweeping mechanism that sweeps dirt from a surface;

a conduit configured to convey the air flow from the head towards the fan unit;

a drive mechanism configured to rotate the head about a first axis while simultaneously rotating the first rotatable member about a second axis and the second rotatable member about a third axis, each of the second axis and the third axis being angled to the first axis; and a dislodging mechanism configured to dislodge dirt from the sweeping mechanism with rotation of the head about the first axis.

* * * * *